US007637696B2

(12) United States Patent
Antill, Sr.

(10) Patent No.: US 7,637,696 B2
(45) Date of Patent: Dec. 29, 2009

(54) UNDERWATER TRENCHING APPARATUS

(75) Inventor: Marvin J. Antill, Sr., Houma, LA (US)

(73) Assignee: Antill Pipeline Construction Co., Inc., Houma, LA (US)

( * ) Notice: Subject to any disclaimer, the term of this patent is extended or adjusted under 35 U.S.C. 154(b) by 0 days.

(21) Appl. No.: 12/150,826

(22) Filed: Apr. 30, 2008

(65) Prior Publication Data

US 2009/0274520 A1 Nov. 5, 2009

(51) Int. Cl.
*F16L 1/16* (2006.01)

(52) U.S. Cl. ..... 405/163; 405/159; 37/317; 37/321; 37/323

(58) Field of Classification Search ..... 405/158, 405/159, 163, 164; 37/317, 321, 322, 323, 37/344

See application file for complete search history.

(56) References Cited

U.S. PATENT DOCUMENTS 296,483 A * 4/1884 Stone ..... 37/344
3,657,829 A * 4/1972 Lovelace ..... 37/323
3,926,003 A * 12/1975 Norman ..... 405/163
4,112,695 A * 9/1978 Chang et al. ..... 405/163
4,154,551 A * 5/1979 Petrie ..... 405/159
4,295,757 A * 10/1981 Gaspar ..... 405/163
4,389,139 A * 6/1983 Norman ..... 405/163
4,479,741 A * 10/1984 Berti et al. ..... 405/163
5,546,682 A * 8/1996 Skerry ..... 405/163
5,603,171 A * 2/1997 Steinkuhler ..... 37/323
6,705,029 B2 * 3/2004 Anderson ..... 405/163
6,874,261 B2 * 4/2005 Smit et al. ..... 37/323

* cited by examiner

*Primary Examiner*—Frederick L Lagman
(74) *Attorney, Agent, or Firm*—Keaty Law Firm

(57) ABSTRACT

An underwater trenching system is mountable on a side of a barge to be propelled by the barge along a waterway, the bed of which contains a trench with a laid pipeline. To remove the excess sediment from the trench the trenching unit delivers pressurized water and air to the trench. A sparge assembly with jet nozzles directs jets of water, breaking up the formation that has built up around the pipeline. The airlift assembly creates a turbulent flow to lift the disturbed sediment and remove it from the created trench.

15 Claims, 5 Drawing Sheets

UNDERWATER TRENCHING APPARATUS

BACKGROUND OF THE INVENTION

The present invention relates to an underwater trenching system, and more particularly, to a trench making equipment that enlarges an underwater trench for burying a pipeline.

Many oil and gas production sites require installation of miles of pipelines for delivery of the produced material to a refinery or other destination. Often times, the pipelines are laid underwater, especially in shallow coastal waters. The pipes are usually buried at the bottom of a waterway, such as a river, marsh, or sea. In some locations, the pipes are simply laid along the bottom of a waterway and left exposed, to be buried by the action of the currents. In other uses, a trenching tool, such as a water jet, a cutter head, or a scoop, or clam shell digger digs a trench around the pipe, which then settles into the trench.

The bottom sediment eventually settles around the pipe although a large portion of it is carried to other areas of the waterway. The time when the sediment remain in suspension varies although it is known to have a potential for creating serious environmental damage to plants, animals, marine life, and the water. Over time, the sediment has a tendency to shift the pipeline, which causes it to rise from the bottom or from the trench. Current governmental regulations prohibit disturbing the waterway bottom for the second time, such that digging out the original trench for adjusting position of the pipeline is not a viable option. As a consequence, the only viable alternative is to excavate the side of the trench near the bottom and cause the pipeline to drop into the new indentation in the soil.

In short, all currently known equipment and methods for underwater trenching create large clouds of silt and debris that remain in suspension for a long time and seriously disrupt the ecology of the waterway. Reforming the trench by additional excavation of the bottom is not allowed.

There exists therefore a need for an underwater trenching system that avoids bottom trenching, while achieving the goal of lowering the pipeline into a trench without excavating the bottom of the trench.

SUMMARY OF THE INVENTION

It is therefore an object of the present invention to provide an underwater trenching system that is capable of evacuating sediment from a side of the trench without substantially disturbing the soil.

It is another object of the invention to provide an underwater trenching system that allows the pipe to settle back into the trench.

It is a further object of the present invention to reduce the time and cost of trenching by omitting the necessity to employ underwater divers.

These and other objects of the invention are achieved through a provision of an underwater trenching apparatus for repairing a trench formed in a bed of a waterway, within which a pipeline is located. The trenching apparatus comprises an elongated boom assembly having a proximate end configured for hingedly securing to a side of a floating vessel, such as a barge. A trenching unit is secured to a distal end of the boom assembly and moves between an above-water position and an underwater position with the help of a lifting means positioned on the deck of the barge, such for instance a lifting crane, a cable of which is detachably secured to the boom assembly.

The trenching unit comprises a pair of spaced-apart opposing sparge assemblies that deliver water and air under pressure to the trench where the pipeline is located. The water and air disturb the underwater formation and move the disturbed sediment or loose formation away from the pipeline in the trench. An elongated conduit admits the sediment through a bottom inlet opening and discharges the sediment through an upper outlet opening. An airlift unit mounted inside the tubular member is connected to an above-water air supply. The airlift unit creates turbulence inside the tubular member, causing sucking of the sediment into the tubular member and lifting the sediment and water toward the discharge opening.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
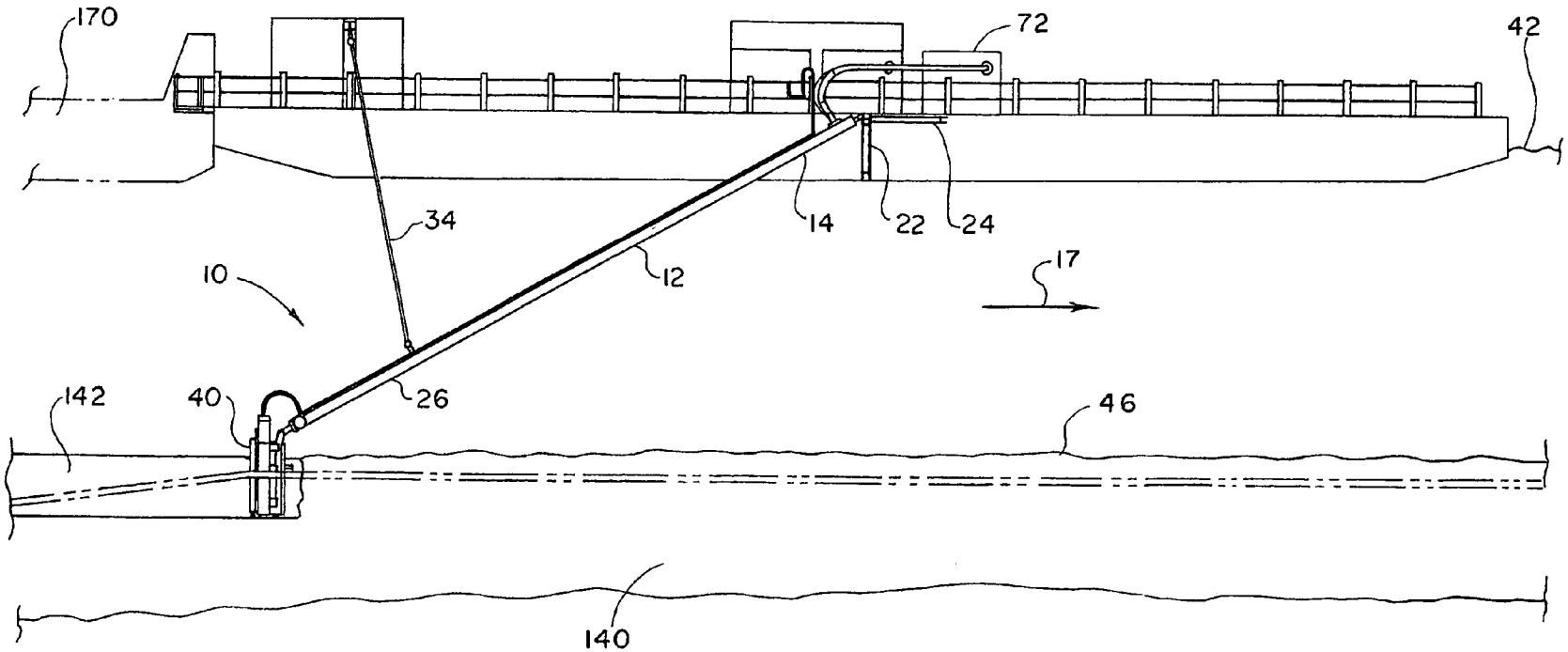
FIG. 1 is a schematic view illustrating the underwater trenching apparatus of the instant invention in operation.

Turning now to the drawings in more detail, the system of the present invention is designated by numeral 10. The system 10 comprises an elongated boom assembly 12, a proximate end 14 of which is secured to a barge 16 or other suitable vessel. Conventional trenching equipment is usually centered on the barge. The system 10, in contrast, is positioned on a side of the barge, with the boom assembly 12 secured to the starboard 20 of the barge 16. Of course, the boom assembly 12 may be also secured to the port of the barge hull, depending on the location of the pipeline in the waterway. In FIG. 1, the trenching system 10 is mounted on the barge 16 that moves in the direction of arrow 17.

Figure 2:
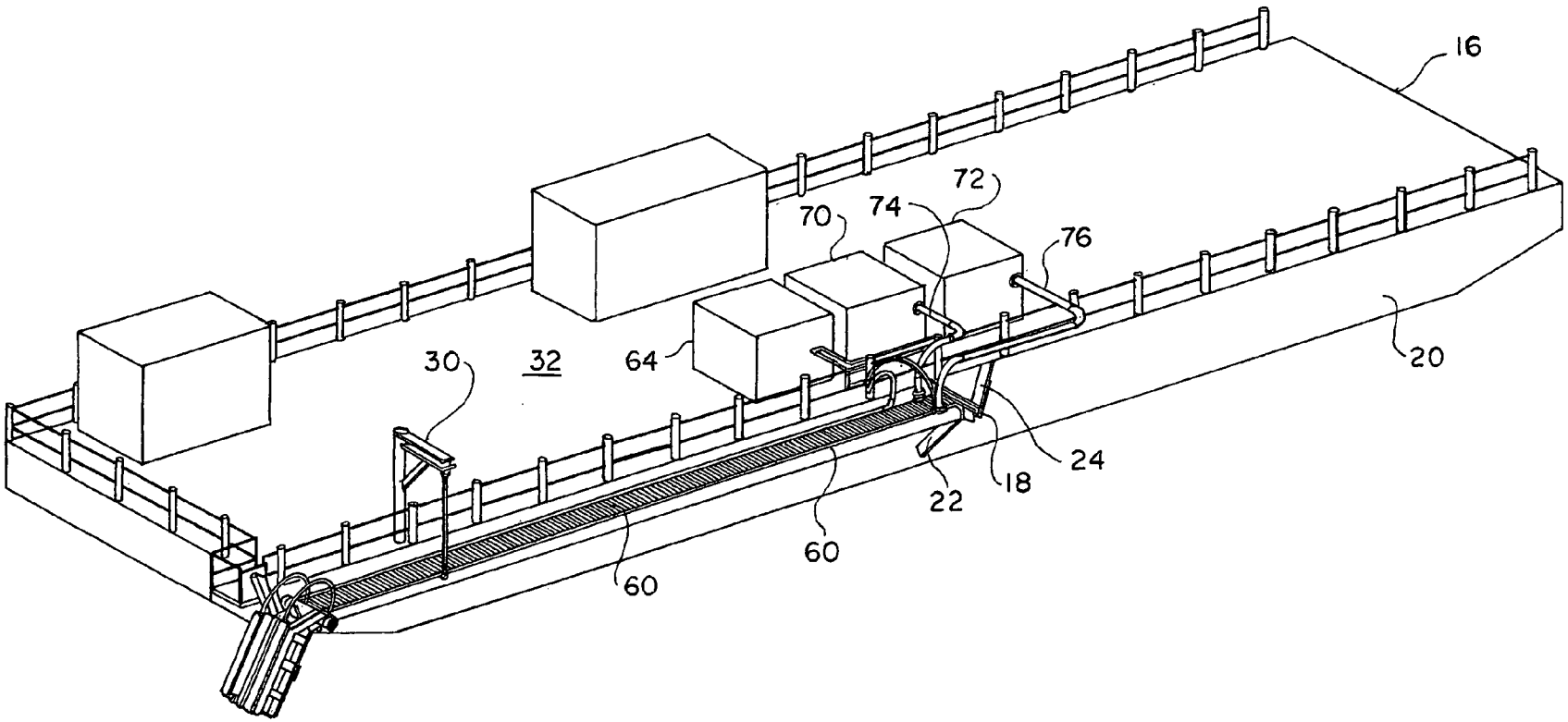
FIG. 2 illustrates the underwater trenching apparatus of the instant invention in transit or storage position.

The proximate end 14 boom assembly 12 is hinged to a hinge plate 18, which can be formed from a length of an I-beam, attached to the starboard 20. The hinge plate 18 extends substantially horizontally, transversely to the starboard 20 and suspends the boom assembly 12 off the side of the barge 16. The boom assembly 12 can move up and down in relation to the hinge plate 18. A support bracket 22 supports the hinge plate 18 from below and absorbs some of the vertical and horizontal forces applied to the hinge plate 18 when the boom assembly 12 moves between a transport position shown in FIG. 2 to an operating position shown in FIG. 1. A second reinforcing bracket 24 may be secured to the hinge plate 18 to further reinforce the position of the hinge plate 18 on the side of the barge 16.

A distal end 26 of the boom assembly 12 is selectively secured to a lifting means 30, which can be a deck crane, positioned on the deck 32 of the barge 16. A lifting cable 34 detachably secures the boom assembly 12 to the lifting crane 30 to raise and lower the boom assembly 12. The distal end 26 of the boom assembly 12 carries a trenching unit 40 that is lowered below the waterline 42 to reach the mud line 46.

The boom assembly 12 comprises a pair of elongated beams 48, 50 which are spaced from each other and are retained in a substantially parallel relationship by a plurality of transverse braces 54 and diagonal braces 56. A mesh walkway 60 is secured between the beams 48, 50, allowing operators to access the trenching unit 40 and to measure the depth, at which the pipeline 62 extends below the mud line 46. The depth measuring can be conducted using conventional devices that are well known in the industry and are not part of the instant invention.

Figure 3:
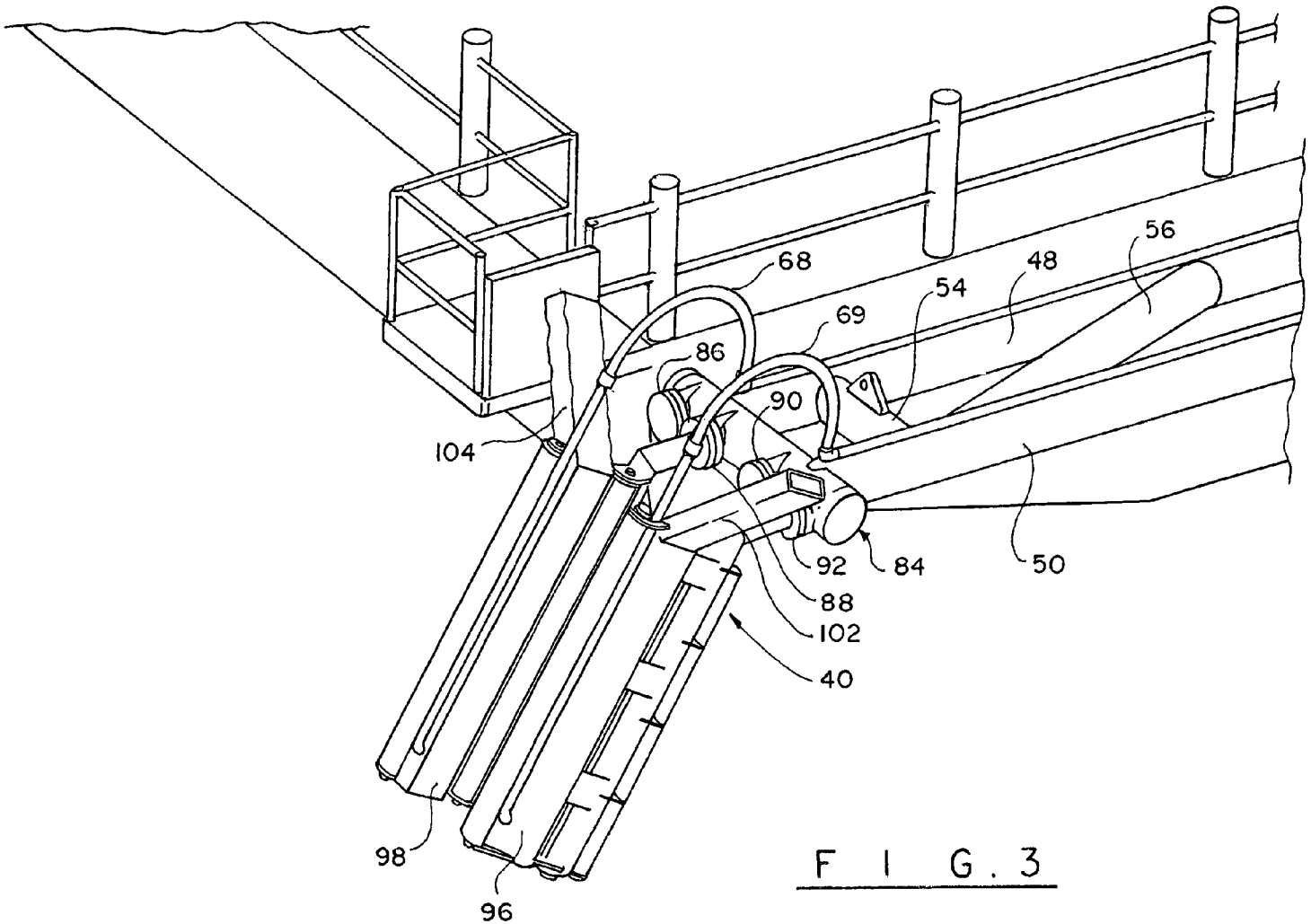
FIG. 3 is a detail view showing the trenching unit connected to a single manifold.

Mounted on the deck 32 of the barge 16 is water and air supply units that deliver water under pressure and pressurized air to the trenching unit 40. As can be seen in FIG. 3, an air compressor 64 is positioned on the deck 32 and is connected to the trenching unit 40 by air supply conduits 68, 69. Water to the trenching unit 40 is supplied by a pair of jet pumps 70, 72 that deliver water to the trenching unit 40 via water conduits 74, 76, respectively. The jet pumps 70, 72 can produce 300 p.s.i. of pressure to the trenching unit 40. The jet pumps are self-contained with fuel tanks, powered generator and an air compressor.

The trenching unit 40 comprises a pair of sparge units 80, 82 that are connected to a single manifold 84 that supplies water under pressure through manifold connectors 86, 88, 90, and 92. Only two manifold connectors are active at a particular time during operation of the trenching unit 40. Depending on the diameter of the pipeline 46 and the width of the desired trench, the trenching unit can be connected, through the manifold connectors to either two adjacent manifold connectors or to a pair of further spaced-apart manifold connectors. In the example illustrated in FIG. 3, manifold connector 88 and 92 are used to supplying the pressurized water to the sparge units 80, 82.

The sparge units 80 and 82 are mirror images of each other. Each of the sparge units comprises a tubular conduit 94 that has a first inlet portion 96, 98, respectively, and a second discharge portion 102, 104, respectively. The discharge portions 102, 104 are oriented at an angle to longitudinal axes of the first inlet portions 96, 98. The outlet openings of the second discharge portions 102, 104 are oriented in opposite directions so that effluent is discharged away from the pipeline 46.

The air supply conduit 68 is secured to the side of the first inlet portion 98 for delivering pressurized air to the interior of the first inlet portion 96. Mounted inside the first inlet portion is an airlift insert 106 that has exterior dimensions slightly smaller than the interior of the first inlet portion conduit 98. The insert 106 is secured inside the conduit defined by the first inlet portion and has a flared inlet opening 108.

Figure 5:
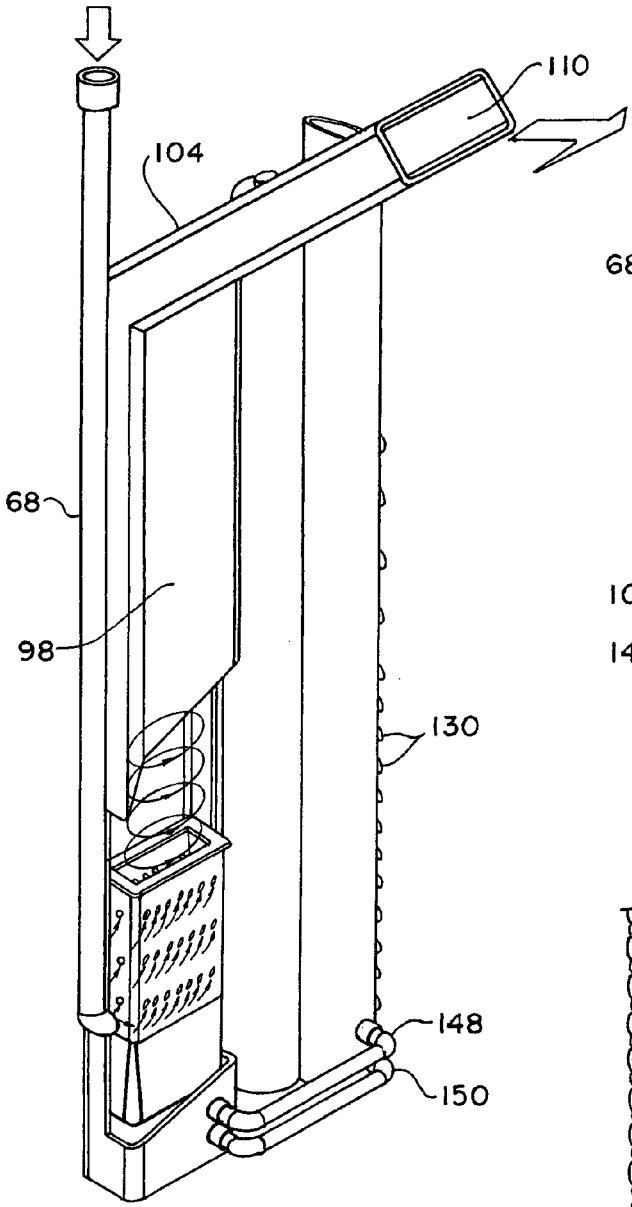
FIG. 5 is detail, partially cut-away view showing one of the sparge assemblies and the airlift insert.
Figure 6:
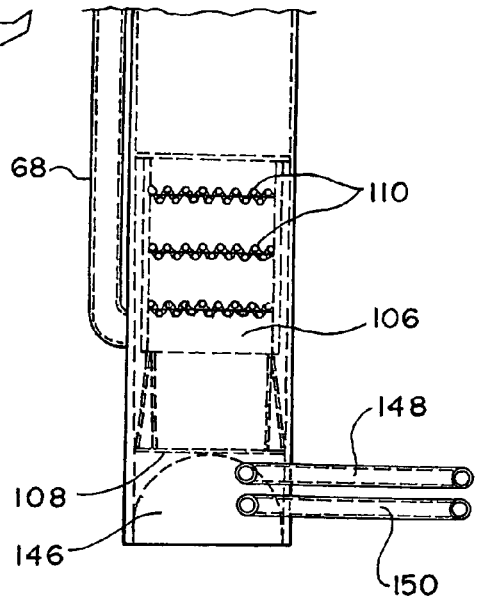
FIG. 6 is a detail view showing the airlift assembly mounted in the inlet portion of the tubular conduit.
Figure 7:
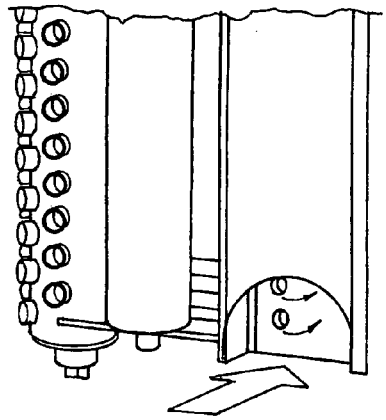
FIG. 7 is detail view of the bottom of the sparge assembly illustrating the direction of intake flow entering the inlet portion of the tubular conduit.

A plurality of openings 110 is formed in the walls of the insert 106 allowing air delivered through the air conduit 68 to enter the interior of the insert 106 and create turbulence inside the insert 106. The turbulent flow carries the sediment, as will be explained in more detail hereinafter, toward the second discharge portion 102 and ultimately—to the discharge opening 112 of the second discharge portion 102. As shown in FIG. 5, the air supply conduit 68 is connected to the interior of the first inlet portion 98 at a level where the openings 110 in the insert 106 are located.

The openings 110 are preferably formed at an angle to the longitudinal axis of the insert 106, as shown in FIG. 5. The inclined openings 110, which can be inclined at about 45 degrees in relation to the longitudinal axis, force the air upward into the first inlet portion 98 and create a turbulent flow therein. The flared bottom of the insert 106 and a reduced size of the remainder of the insert body 106 also facilitate the creation of a sucking force by creating a venturi effect and drop in pressure as the flow moves through the tubular portions 96, 102 (98, 104).

Each sparge unit 80, 82 is provided with a sparge conduit 120, 122, respectively. The sparge conduits 120, 122 are connected to the manifold 84 through manifold connector flanges 124, 126. Each sparge conduit 120, 122 is provided with a plurality of discharge nozzles 128, 130 that jet pressurized water/air mixture into the waterway bed 140 in the area adjacent the pipeline 46. The nozzles 128, 130 are detachably mounted in the corresponding openings formed in the wall of the sparge conduits 120, 122.

Figure 8:
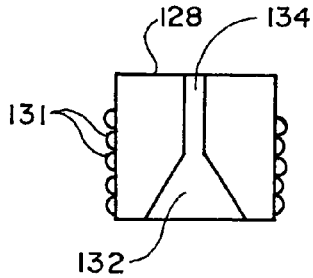
FIG. 8 is a detail view of the nozzle of the sparge conduit.

Each nozzle has exterior threads 131 that allow the nozzle to be threaded into the opening in the wall of the sparge conduit. An inlet opening 132 of the nozzle 128 (or 130) has a generally conical configuration, as can be seen in more detail in FIG. 8. An outlet opening 134 has a diameter smaller than the diameter of the inlet opening 132, such that the velocity of the fluid exiting the nozzle 128 (130) is increased causing a jetting effect. The water and air exiting the outlet opening 134 blast away sediment from the bottom of the waterway enlarging the trench 142 surrounding the pipeline 46.

The disturbed sediment is sucked into the bottom opening 146 of the first inlet portion 98 and moves through the insert 106 under the force of the flow created by the incoming air flow. Some of the water moving through the sparge conduit 120 is diverted to the first inlet portion 98 below the airlift insert 106 by a pair of water hoses, or pipes 148, 150 to facilitate movement of the sediment through the trenching unit 40. The sediment can be discharged to the waterway bed 140 above the mud line 46 or, if the trench is shallow—even to the banks of the waterway.

Figure 4:
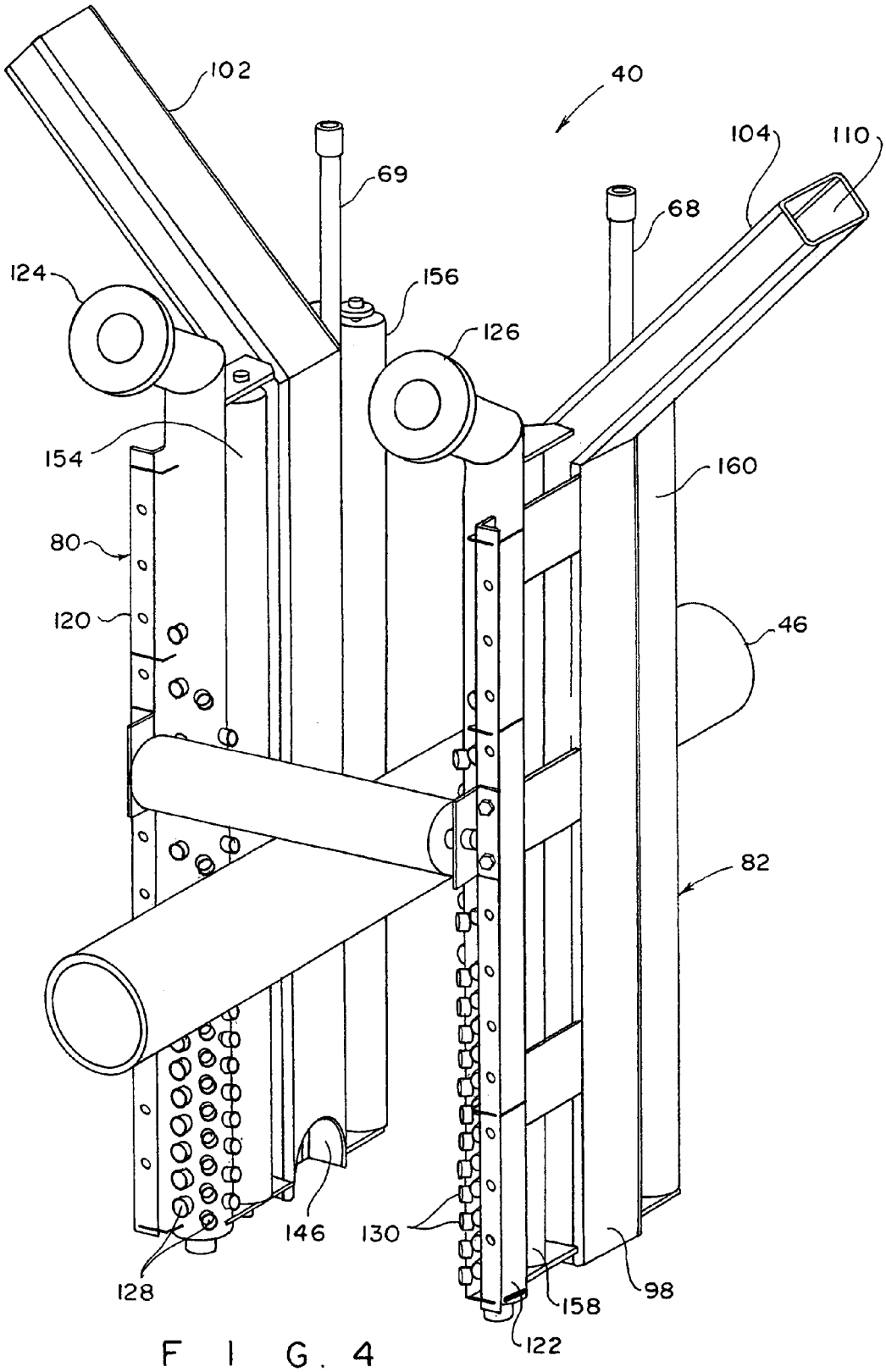
FIG. 4 is a detail view showing the trenching unit with its pair of sparge assemblies.

To ensure alignment of the trenching unit 40 with the pipeline 46, the trenching unit 40 is provided with a guiding means, which comprises a plurality of rotating guiding rollers. A transverse roller 152 is secured between the sparge conduits 120, 122 at a position downstream from the inlets openings of the sparge conduits 12, 122. In the embodiment shown in FIG. 4, the transverse roller 152 is positioned at an approximate level above an anticipated depth of the pipeline 46.

A pair of vertical guiding rollers 154, 156 is positioned in a general vertical alignment with the first inlet portion 96, and a similar pair of vertical guiding rollers 158, 160 is positioned in a general vertical alignment with the first inlet portion 98. The rollers 154, 156, 158, and 160 prevent the trenching unit 40 from significantly deviating from the dimensions created by the sides of the trench, where the pipeline 46 is located. The distance between the rollers 154, 156 and 158, 160 is selected to conserve energy and enlarge the trench 142 only as necessary for the pipeline 46.

The barge 16 can be propelled by a tug boat 170 shown in phantom line in FIG. 1, or by other suitable means that allow the trenching unit 40 to move along the pipeline and enlarge or form a trench. If desired, the roller guides 154, 156, 158 and 160 can be distanced to straddle the pipe 46 and keep the trenching unit 40 aligned with the pipeline 46. The rollers are also important in protecting the conduits from contact with rocky trench walls.

If desired the nozzles 128, 130 can be strategically spaced along the length of the inlet portions such that the majority of the nozzles are located closer to the bottom of the trench, while fewer nozzles are located in an area that would be approximately above the pipeline 46. The depth of the pipeline 46 embedment can be measured prior to lowering the trenching unit 40 into water.

The barge 16 is propelled along the waterway at a desired speed, allowing the sparge units 80, 82 to disturb underwater sediment and for the airlift force to lift the disturbed sediment away from the trench. The actual speed of travel depends on the condition of the waterway bed. Naturally, slower speed will be necessary where there exists clay bottom than where the bed is sandy. It is envisioned that a land vehicle may be employed for transporting the trenching apparatus of the present invention. Depending on several factors, such as the width of the waterway, the location of the pipeline and the depth, at which the pipeline is buried the land vehicle with the boom assembly mounted thereon may be employed.

Many changes and modifications can be made in the design of the present invention without departing from the spirit thereof. I therefore pray that my rights to the present invention be limited only by the scope of the appended claims.

I claim:

1. An underwater trenching apparatus, comprising:

an elongated boom assembly having a proximate end secured to a propelling vehicle;

a trenching unit secured to a distal end of the boom assembly, said trenching unit being adapted for movement between an above-water position and an underwater position, said trenching unit having a means for delivering air and water under pressure to a trench location underwater to disturb underwater formation and for moving the disturbed formation away from the trench location, said trenching unit comprising at least one sparge assembly, said at least one sparge assembly comprising a sparge conduit provided with a plurality of jetting nozzles, an elongated tubular member secured adjacent said sparge conduit, and an airlift insert mounted in the tubular member for creating turbulence inside the tubular member and facilitating movement of the formation through said tubular member, said airlift insert comprises a tubular body having a flared inlet opening and a reduced size main body, and wherein a plurality of openings is formed in said main body for receiving air from said means for delivering pressurized air; and a means for delivering pressurized air to the tubular member, said means for delivering pressurized air being operationally connected to said airlift insert.

2. The device of claim 1, wherein said openings are defined by apertures formed in peripheral walls of the main body at an acute angle to a longitudinal axis of the main body.

3. The apparatus of claim 1, wherein said elongated tubular member comprises a first inlet portion and a second discharge portion oriented at an angle in relation to a longitudinal axis of the first inlet portion.

4. An underwater trenching apparatus, comprising:

an elongated boom assembly having a proximate end secured to a propelling vehicle;

a trenching unit secured to a distal end of the boom assembly, said trenching unit being adapted for movement between an above-water position and an underwater position, said trenching unit having a means for delivering air and water under pressure to a trench location underwater to disturb underwater formation and for moving the disturbed formation away from the trench location, said trenching unit comprising at least one sparse assembly, said at least one sparse assembly comprising a sparge conduit provided with a plurality of jetting nozzles, an elongated tubular member secured adjacent said sparse conduit, and an airlift insert mounted in the tubular member for creating turbulence inside the tubular member and facilitating movement of the formation through said tubular member, said elongated tubular member comprising a first inlet portion and a second discharge portion oriented at an angle in relation to a longitudinal axis of the first inlet portion wherein said sparge assembly further comprises a means for delivering water to the first inlet portion of the tubular member.

5. The apparatus of claim 4, wherein said first inlet portion is provided with an inlet opening located below said airlift assembly, and wherein said means for delivering water to the first inlet portion of the tubular member is connected to the inlet opening.

6. An underwater trenching apparatus, comprising:

an elongated boom assembly having a proximate end secured to a propelling vehicle, a trenching unit secured to a distal end of the boom assembly, said trenching unit being adapted for movement between an above-water position and an underwater position, said trenching unit having a means for delivering air and water under pressure to a trench location underwater to disturb underwater formation and for moving the disturbed formation away from the trench location, said trenching unit comprising at least one sparse assembly, said at least one sparse assembly comprising a sparse conduit provided with a plurality of jetting nozzles, an elongated tubular member secured adjacent said sparge conduit, and an airlift insert mounted in the tubular member for creating turbulence inside the tubular member and facilitating movement of the formation through said tubular member, each of said jetting nozzles being detachably secured to said at least one sparse conduit, and wherein each of said jetting nozzles comprises a tubular body having exterior threads for threadably engaging with sparge conduit and a through opening, said through opening having a conical inlet part and a reduced size discharge part.

7. An underwater trenching apparatus, comprising:

an elongated boom assembly having a proximate end secured to a propelling vehicle;

a trenching unit secured to a distal end of the boom assembly, said trenching unit being adapted for movement between an above-water position and an underwater position, said trenching unit having a means for delivering air and water under pressure to a trench location underwater to disturb underwater formation and for moving the disturbed formation away from the trench location, wherein said trenching unit comprises a pair of spaced-apart sparge assemblies, each of said pair of sparge assemblies comprising a sparge conduit provided with a plurality of jetting nozzles, an elongated tubular member secured adjacent said sparge conduit, and an airlift insert mounted in the tubular member for creating turbulence inside the tubular member and facilitating movement of the formation through said tubular member.

8. The apparatus of claim 7, wherein tubular members of said sparge assemblies each comprise a discharge portion, and wherein a discharge opening of one tubular member is oriented away from a discharge opening of another tubular member.

9. An underwater trenching apparatus for repairing a trench formed in a bed of a waterway, within which a pipeline is located, the trenching apparatus comprising:

an elongated boom assembly having a proximate end configured for hingedly securing to a side of a floating vessel;

a trenching unit secured to a distal end of the boom assembly, said trenching unit being adapted for movement between an above-water position and an underwater position, said trenching unit comprising a pair of spaced-apart opposing sparse assemblies and a means for delivering air and water under pressure to a trench location through said pair of sparse assemblies to disturb underwater formation and for moving the disturbed formation away from the pipeline in the trench, wherein each of said pair of sparge assemblies comprises a sparge conduit provided with a plurality of jetting nozzles, an elongated tubular member secured adjacent said sparge conduit, and an airlift insert mounted in the tubular member for creating turbulence inside the tubular member and facilitating movement of the formation through said tubular member.

10. The apparatus of claim 9, wherein said jetting nozzles are configured for delivering water and air under pressure to a bottom and sides of the trench surrounding the pipeline.

11. The apparatus of claim 9, wherein said jetting nozzles are detachably secured on said sparge conduit.

12. The apparatus of claim 9, wherein said airlift insert comprises a tubular body having a flared inlet opening and a reduced size main body, and wherein a plurality of angularly-oriented openings is formed in said main body for receiving air from said means for delivering pressurized air.

13. The apparatus of claim 9, wherein said elongated tubular member comprises a first inlet portion and a second discharge portion oriented at an angle in relation to a longitudinal axis of the first inlet portion.

14. The apparatus of claim 13, wherein said sparge assembly further comprises a means for delivering water to the first inlet portion of the tubular member, said first inlet portion being provided with an inlet opening located below said airlift assembly, and wherein said means for delivering water to the first inlet portion of the tubular member is connected to the inlet opening.

15. The apparatus of claim 9, wherein each of said jetting nozzles is detachably secured to said at least one sparge conduit.

* * * * *